US007204385B2

(12) United States Patent
Rockhill et al.

(10) Patent No.: US 7,204,385 B2
(45) Date of Patent: Apr. 17, 2007

(54) VENTED DRINKING VESSEL IN THE STYLE OF A RACECAR FUELING TANK

(75) Inventors: Larry Rockhill, Kennesaw, GA (US); Jason Doucet, Duluth, GA (US); Michael J. Mehrman, Atlanta, GA (US)

(73) Assignee: Hi-Performance Products, Inc., Northport, AL (US)

( * ) Notice: Subject to any disclaimer, the term of this patent is extended or adjusted under 35 U.S.C. 154(b) by 315 days.

(21) Appl. No.: 10/860,203

(22) Filed: Jun. 3, 2004

(65) Prior Publication Data

US 2005/0269336 A1 Dec. 8, 2005

(51) Int. Cl.
*A47G 19/22* (2006.01)
*B65D 83/00* (2006.01)

(52) U.S. Cl. ..... 220/705; 220/707; 215/388

(58) Field of Classification Search ..... 220/705, 220/707, 711, 745, 770; 215/388–89
See application file for complete search history.

(56) References Cited

U.S. PATENT DOCUMENTS 416,939 A * 12/1889 Moore ..... 222/468
2,355,010 A * 8/1944 Pera ..... 220/710
D186,535 S * 11/1959 Saffer ..... D7/535
5,167,354 A * 12/1992 Cohanfard ..... 224/148.2
D348,802 S * 7/1994 Miller, III ..... D7/510
D413,798 S * 9/1999 LaMarra ..... D9/717
6,135,311 A * 10/2000 Panec et al. ..... 220/705
6,375,092 B1 * 4/2002 Banach ..... 239/33
2004/0084485 A1 * 5/2004 Carlton ..... 222/527

* cited by examiner

*Primary Examiner*—Jes F. Pascua
*Assistant Examiner*—Shawn M. Braden
(74) *Attorney, Agent, or Firm*—Michael J. Mehrman; Mehrman Law Office PC

(57) ABSTRACT

A vented drinking vessel in the style of a racecar fueling tank of the types used at pit stops during NASCAR® races. The vented drinking vessel includes a vent tube or solid handle that looks similar to the vent tube of a racecar fueling tank. The vented container also includes a curved straw similar to the exit pipe on a racecar fueling tank, which the user may drink from in the usual manner. To prevent spilling, the vented drinking vessel may include one or more valves, such as a one-way valve removable located within the vent tube and/or a check valve removable located within the curved straw, typically at the end of the straw. The vessel may include an internal straw that extends from the bottom of the curved straw into the container.

20 Claims, 4 Drawing Sheets

VENTED DRINKING VESSEL IN THE STYLE OF A RACECAR FUELING TANK

TECHNICAL FIELD

The present invention relates to drinking vessels and, more particularly, to a vented drinking vessel in the style of a racecar fueling tank.

BACKGROUND OF THE INVENTION

Beverages are sold in large volume at sporting events, and the cups in which the beverages are served often serve as souvenirs for the fans. The cups also provide valuable advertising space which may be used by the sports team, the venue, team sponsors, or sold to others. Traditional drinking cups, however, suffer from a number of disadvantages. In particular, most cups have a standard shape that is not particularly eye catching. Although mugs, containers and cups having a variety of stylized shapes have been developed, there is an continuing need for need for drinking containers with distinctive shapes that find favor with sports fans. Fans of NASCAR® races, in particular, exhibit extraordinary enthusiasm and often purchase products that demonstrate their support for their sport, such as purchasing, wearing and carrying products carrying sponsor logos and the numbers, names, likenesses and signatures of the sport's drivers.

In addition, traditional drinking cups spill all too easily when they tip or drop because most cup lids come loose when the cup is squeezed, knocked over or jostled. This problem can be made worse by accident prone and mischievous children. Closed squeeze containers solve this problem to some extent, but they still leak and spill when knocked over or squeezed. Closed squeeze containers can also be difficult to drink from as vacuum collapses the container during drinking.

Accordingly, there is an ongoing need for a drinking vessel that evokes the imagery of popular sports, such as NASCAR® races. There is a further need for a non-spill drinking container that evokes the imagery of NASCAR® races and is adapted to carry sponsor logos and the numbers, names, likenesses and signatures of the sport's drivers.

SUMMARY OF THE INVENTION

The present invention meets the needs described above in vented drinking vessel in the style of a racecar fueling tank of the type used at pit stops during NASCAR® races. The vented drinking vessel includes a vent tube or solid handle that looks similar to the vent tube of a racecar fueling tank. The vented drinking vessel also includes a curved straw similar to the exit pipe on a racecar fueling tank, which the user may drink from in the usual manner. The curved straw typically extends from the top of a funnel portion at the top of the fuel container, which is also similar to the design of a racecar fueling tank.

To prevent spilling, the vented drinking vessel may include one or more valves in communication with the interior of the container, such as a one-way valve that is removable located within the vent tube, typically at the end of the tube. Alternatively or additionally, the vented drinking vessel may also include a check valve that is removable located within the curved straw, typically at the end of the straw. The vented drinking vessel may include an internal straw that extends from the bottom of the curved straw into and preferable to the bottom of the container. In this case, the check valve may be located in the internal straw. The funnel portion typically separates from the bottom portion of the container to make the container easy to fill and clean.

The vented drinking vessel may be a squeeze type container or it may be hard sided. In either case, logos, other advertising material and decorative material may be located on the outside of the container. A low cost option may be manufactured form plastic, while a more expensive collector's quality container may be manufactured from spun aluminum, stainless steel or another suitable material.

Generally described, the invention may be embodied as a vented drinking vessel including a cylindrical container closed at a bottom end, open at a top end, and including a vent opening adjacent to the bottom end. A funnel shaped cap is removably secured to the cylindrical container, and a curved straw extends from the funnel shaped cap. The vented drinking vessel also includes a vent tube in communication with the vent opening, located outside the container, and extending beyond the top end of the container. For example, the vent tube may extend to a point approximately even with the top of the funnel shaped cap.

The curved straw may also include a flared portion located away from the funnel shaped cap. The vent tube may be supported by an arm extending between the cylindrical container and the vent tube adjacent to the top end of the cylindrical container. The vented drinking vessel may also include one or more valves to prevent spillage from the vessel. For example, the vented drinking vessel may include a check valve associated with the curved straw and/or a one-way valve associated with the vent tube to prevent spillage from the vessel. The vented drinking vessel may also include an internal straw in communication with the curved straw and extending into the cylindrical container. The vessel may be fabricated substantially from plastic, and may have a rigid or flexible container. That is, the plastic container may be squeezable or not. Alternatively, the vessel may be fabricated substantially from aluminum (typically spun aluminum), in which case the container will not be squeezable.

The vented drinking vessel may also be embodied as a cylindrical container closed at a bottom end, open at a top end, and including a vent opening. The vessel also includes a one-way valve in communication with the vent opening and a funnel shaped cap removably secured to the cylindrical container. A curved straw extends from the funnel shaped cap, and a handle is located outside the container and extending from near the bottom of the container beyond the top end of the container. This embodiment may also include a check valve associated with the curved straw.

The specific techniques and structures for implementing particular embodiments of the internally switched electric power interrupter, and thereby accomplishing the advantages described above, will become apparent from the following detailed description of the embodiments and the appended drawings and claims.

DETAILED DESCRIPTION OF THE EMBODIMENTS

Figure 3:
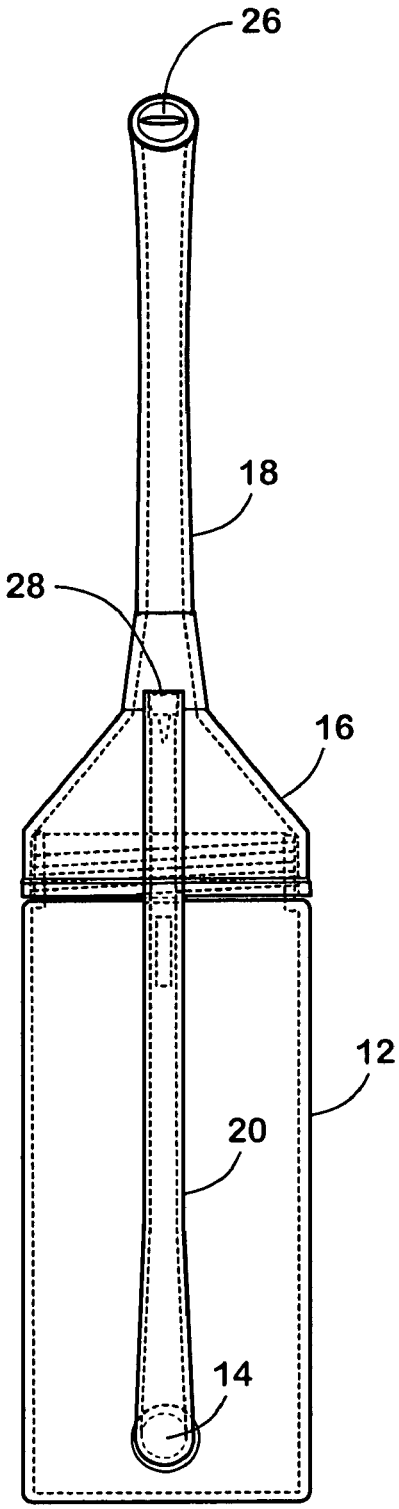
FIG. 3 is a top view of the vented drinking vessel.
Figure 2:
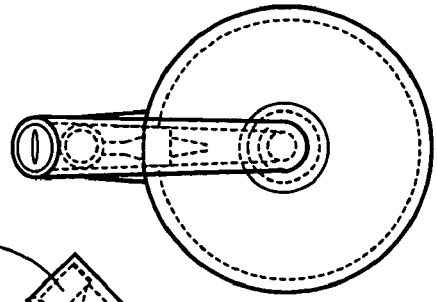
FIG. 2 is a front view of the vented drinking vessel.
Figure 1:
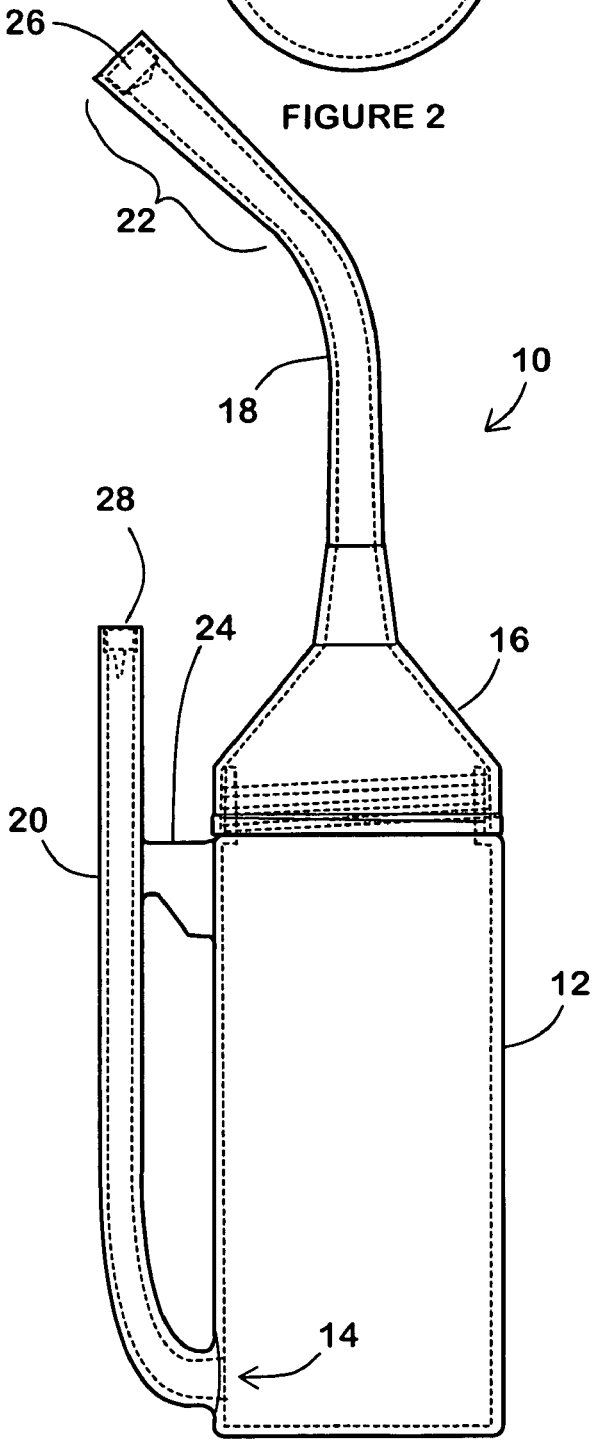
FIG. 1 is a side view of a vented drinking vessel.
Figures 4, 5, 6:
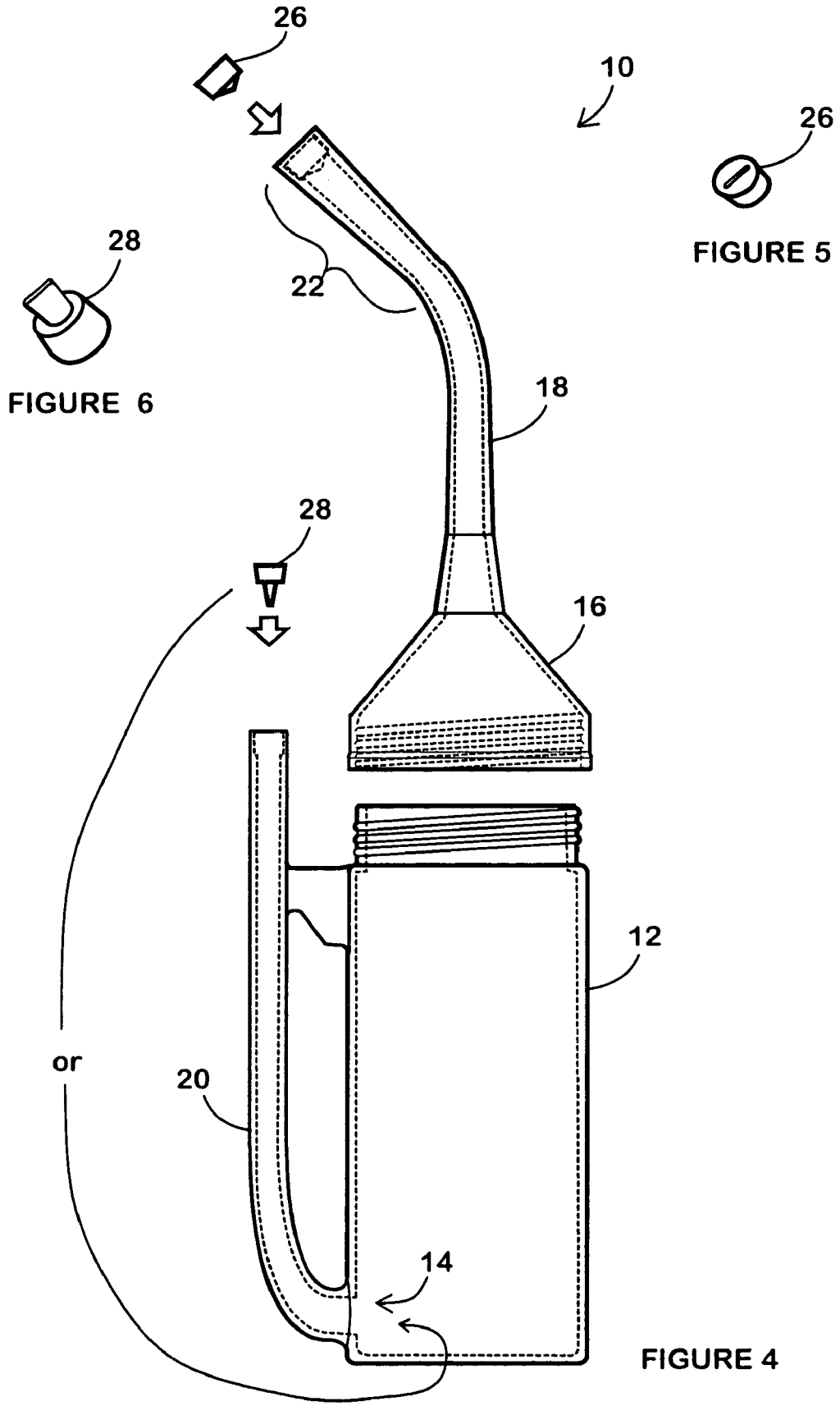
FIG. 4 an exploded side view of the vented drinking vessel.
FIG. 5 is a perspective view of a check valve for a vented drinking vessel.
FIG. 6 is a perspective view of a one-way valve for a vented drinking vessel.

Turning now to the drawings, in which like numerals refer to like elements throughout the several figures, FIG. 1 is a side view, FIG. 2 is a top view, FIG. 3 is a front view, and FIG. 4 is an assembly view of a vented drinking vessel 10, which includes a cylindrical container 12 closed at a bottom end, open at a top end, and including a vent opening 14 adjacent to the bottom end. Locating the vent opening 14 near the bottom of the container allows the fluid inside the vessel to flow freely out of the vessel, without rapidly bubbling or "glugging" on the way out. This makes the vessel well suited to rapid and smooth evacuation of its contents.

A funnel shaped cap 16 is removably secured to the cylindrical container 12, and a curved straw 18 extends from the funnel shaped cap. Typically, the funnel shaped cap 16 screws onto the cylindrical container 12, but other removable attachment techniques, such as a friction seal or a "push and twist" connector may be employed. The vented drinking vessel also includes a vent tube 20 (in an alternative embodiment, the vent tube may be replaced by a solid handle) in communication with the vent opening 14, located outside the container 12, and extending beyond the top end of the container. For example, the vent tube may extend to a point approximately even with the top of the funnel shaped cap 16. In addition, the curved straw 18 typically includes a flared portion 22 located away from the funnel shaped cap 16. The vent tube 20 may be supported by an arm 24 extending between the cylindrical container 12 and the vent tube adjacent to the top end of the cylindrical container.

As shown in FIG. 4, the vented drinking vessel 10 is preferably formed of two major components, the container 12 with attached vent tube 20, and the funnel shaped cap 16 with attached curved straw 18. However, those skilled in the art will recognize that other configurations are possible, such as a configuration in which the curved straw 18 separates from the funnel shaped cap 16. Similarly, the vent tube 20 may detach from the container 12 if desired.

Of course, the vented drinking vessel 10 may be used without any valve, in which case the fluid inside the vessel will flow freely when the vessel is tilted or inverted. For this type of free flowing mode, it may be desirable for the curved straw 18 to flex into different positions or rotate with respect to the funnel shaped cap 16, or to be fixed in an orientation curving away from the vent tube 20, to facilitate drinking from the vessel when the vent tube 20 is not regulated by a valve. To prevent spillage, the vented drinking vessel may also include a check valve 26 associated with the curved straw 18 and/or a one-way valve 28 associated with the vent tube 20. FIG. 5 is a perspective view of one embodiment of the check valve 26. In this example, the check valve 26 may be a silicon or other suitable type of valve with a curved diaphragm having a slit which remains closed except when a pressure is applied by sucking on the curved straw 18 or squeezing the container 12. The check valve 26 is typically located along the curved straw 18, for example at the end as shown in FIG. 4 or at the base of the straw adjacent to the funnel shaped cap 16. It should be noted that the check valve 26 will prevent a large spill if the vessel is knocked over, but a small amount of fluid may escape from the vent tube 20 when the vessel is knocked over if a one-way valve is not is not placed in the vent tube. Moreover, the check valve 26 will not prevent a person from spilling fluid through the vent tube 20 by blowing into the curved straw 18.

Alternatively or additionally, the vessel 10 may include a one-way valve 28, such as a silicon or other suitable type of duck-bill valve, in communication with the interior of the vessel. FIG. 6 is a perspective view of one embodiment of the one-way valve 28. The one-way valve 28 prevents fluid inside the container from escaping through the vent tube 20 but does not inhibit the flow of fluid through the curved straw 18. The one-way valve 28 will prevent substantially all spillage through the vent tube 20, and will also prevent a person from spilling fluid through the vent tube by blowing into the curved straw 18. This may be desirable, for example, with small children. The one-way valve 28 may be located anywhere along the vent tube 20, for example at the end of the vent tube or in the vent opening 14 as shown in FIG. 4.

If the one-way valve 28 is located in the vent opening 14, the vent tube 20 may be replaced by a solid handle including a port adjacent to and in communication with the vent opening 14. Further, for the embodiment with a one-way valve 28 in the vent opening 14, the vent opening and one-way valve need not be associated with the handle, and could be located anywhere in communication with the interior of the container 12. For example, the vent opening 14 and one-way valve 28 could be located in the bottom of the container 12, side of the container, or in the funnel shaped cap 16.

Figure 7:
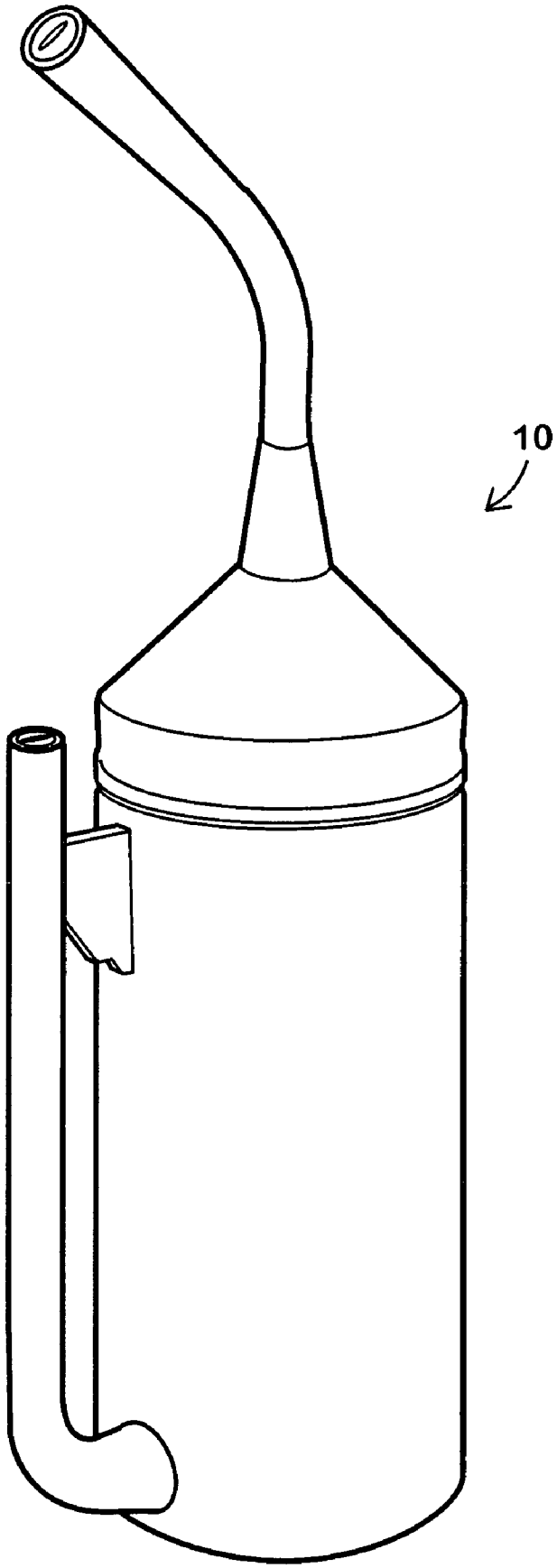
FIG. 7 is a perspective view of the vented drinking vessel.
Figure 8:
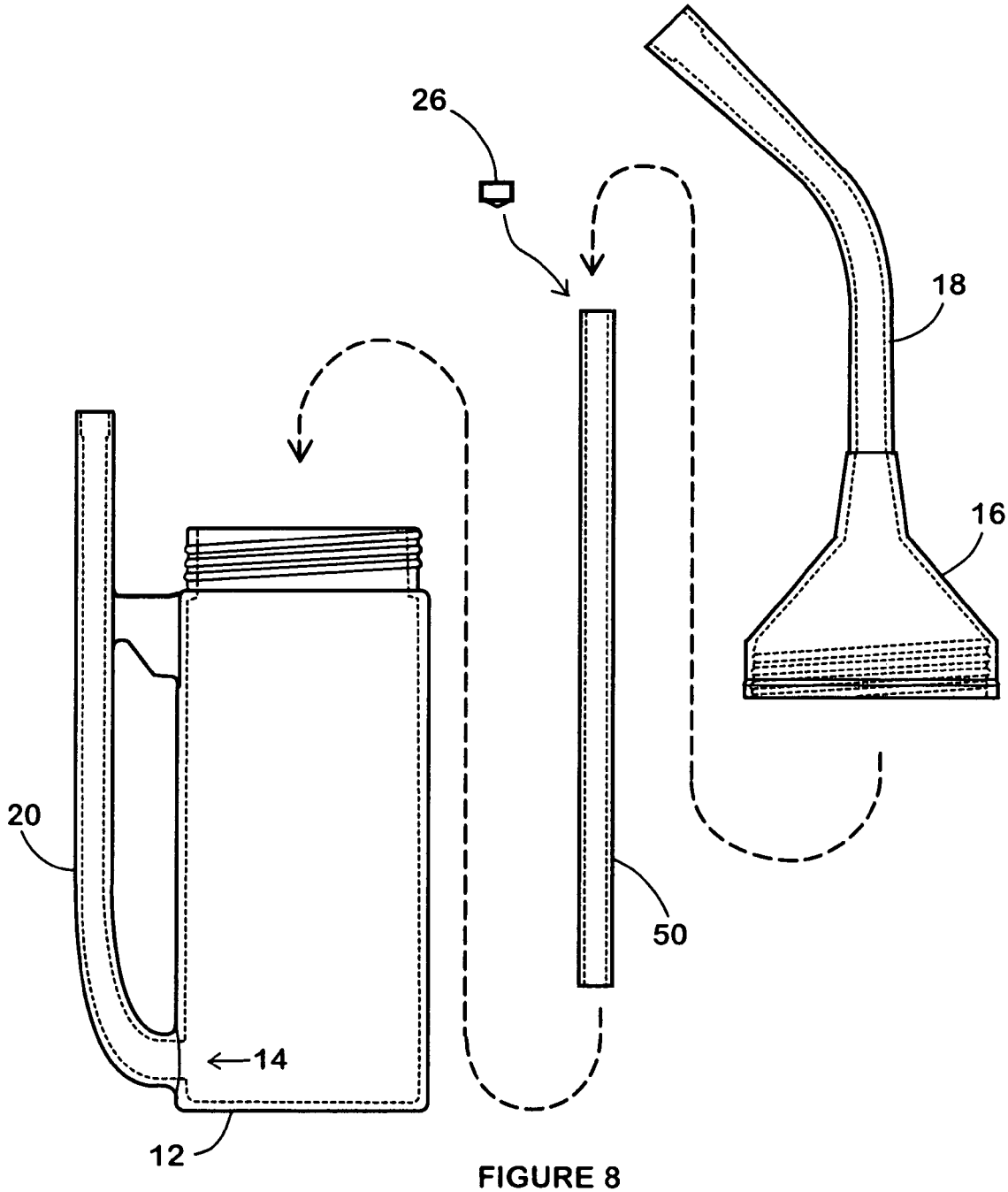
FIG. 8 is a assembly view of the vented drinking vessel.

FIG. 7 is an assembled perspective view of the vented drinking vessel, and FIG. 8 is an assembly view showing that the vessel may include an optional internal straw 50 in communication with the curved straw and extending into the cylindrical container. For this embodiment, the check valve 26 may be located in the internal straw 50, typically at the top or bottom of the straw. This configuration allows the vented drinking vessel 10 to be easily converted from a free-flowing vessel to a no-spill vessel with the insertion of the internal straw 50. This embodiment may also be used with a one-way valve 28 if desired.

The vessel 10 may be fabricated substantially from plastic, and may have a rigid or flexible container. That is, the plastic container may be squeezable or not. Alternatively, the vessel may be fabricated substantially from aluminum (typically spun aluminum), in which case the container will not be squeezable. Of course, other suitable materials may be used for the various components.

In view of the foregoing, it will be appreciated that present invention provides significant improvements in vented drinking vessels. It should be understood that the foregoing relates only to the exemplary embodiments of the present invention, and that numerous changes may be made therein without departing from the spirit and scope of the invention as defined by the following claims.

The invention claimed is:

1. A vented drinking vessel, comprising:

a cylindrical container closed at a bottom end, open at a top end, and including a vent opening adjacent to the bottom end;

a funnel shaped cap removably secured to the cylindrical container;

a curved straw extending from the funnel shaped cap;

a vent tube in communication with the vent opening, and extending from the vent opening along side the container to an upper end; and a valve associated with the vent tube for allowing air to enter the container through the vent tube to facilitate a flow of fluid from inside the container through the straw, and preventing spillage of the fluid through the vent tube.

2. The vented drinking vessel of claim 1, wherein the curved straw further comprises a flared portion located away from the funnel shaped cap.

3. The vented drinking vessel of claim 1, further comprising a support arm extending between the cylindrical container and the vent tube adjacent to the top end of the cylindrical container.

4. The vented drinking vessel of claim 1, wherein the valve comprises a one-way valve located proximate to the upper end of the vent tube.

5. The vented drinking vessel of claim 1, further comprising a check valve associated with the curved straw.

6. The vented drinking vessel of claim 4, wherein the one-way valve is removable from the vent tube.

7. The vented drinking vessel of claim 1, wherein the vent tube extends beyond the top end of the container.

8. The vented drinking vessel of claim 1, further comprising an internal straw in communication with the curved straw and extending into the cylindrical container.

9. The vented drinking vessel of claim 1, fabricated substantially from plastic.

10. The vented drinking vessel of claim 1, fabricated from substantially aluminum.

11. A vented drinking vessel, comprising:

a cylindrical container closed at a bottom end, open at a top end, and including a vent opening adjacent to the bottom end;

a funnel shaped cap removably secured to the cylindrical container;

a curved straw extending from the funnel shaped cap;

a handle located outside the container and extending from near the bottom of the container beyond the top end of the container; and a one-way valve in communication with the vent opening.

12. The vented drinking vessel of claim 11, further comprising a check valve associated with the curved straw.

13. The vented drinking vessel of claim 11, further comprising a support arm extending between the cylindrical container and the vent tube adjacent to the top end of the cylindrical container.

14. The vented drinking vessel of claim 11, wherein the curved straw further comprises a flared portion located away from the funnel shaped cap.

15. The vented drinking vessel of claim 11, further comprising an internal straw in communication with the curved straw and extending into the cylindrical container.

16. The vented drinking vessel of claim 11, fabricated substantially from plastic.

17. The vented drinking vessel of claim 11, fabricated from substantially aluminum.

18. A vented drinking vessel, comprising:

a cylindrical container closed at a bottom end, open at a top end, and including a vent opening adjacent to the bottom end;

a funnel shaped cap removably secured to the cylindrical container;

a curved straw extending from the funnel shaped cap;

a vent tube in communication with the vent opening, located along side the container; and a one-way valve associated with the vent tube to prevent spillage from the vessel through the vent tube.

19. The vented drinking vessel of claim 18, further comprising a support arm, extending between the cylindrical container and the vent tube adjacent to the top end of the cylindrical container.

20. The vented drinking vessel of claim 19, further comprising a straw in communication with the curved straw and extending into the cylindrical container.

* * * * *